US010434397B2

(12) United States Patent
Kounellas

(10) Patent No.: US 10,434,397 B2
(45) Date of Patent: Oct. 8, 2019

(54) INFRARED HOCKEY PUCK AND GOAL DETECTION SYSTEM

(71) Applicant: Jamilla Kounellas, Seattle, WA (US)

(72) Inventor: Jamilla Kounellas, Seattle, WA (US)

( * ) Notice: Subject to any disclaimer, the term of this patent is extended or adjusted under 35 U.S.C. 154(b) by 0 days.

(21) Appl. No.: 15/845,681

(22) Filed: Dec. 18, 2017

(65) Prior Publication Data

US 2018/0104563 A1 Apr. 19, 2018

Related U.S. Application Data

(63) Continuation of application No. 14/323,026, filed on Jul. 3, 2014.

(60) Provisional application No. 61/842,495, filed on Jul. 3, 2013.

(51) Int. Cl.

| | |
|---|---|
| ***A63B 43/00*** | (2006.01) |
| ***A63B 63/00*** | (2006.01) |
| ***A63B 67/14*** | (2006.01) |
| ***A63B 71/06*** | (2006.01) |
| ***A63B 102/24*** | (2015.01) |

(52) U.S. Cl.

CPC ..... *A63B 71/0605* (2013.01); *A63B 43/00* (2013.01); *A63B 63/004* (2013.01); *A63B 67/14* (2013.01); *A63B 43/008* (2013.01); *A63B 2102/24* (2015.10); *A63B 2207/02* (2013.01); *A63B 2225/15* (2013.01); *A63B 2225/54* (2013.01)

(58) Field of Classification Search

CPC ..... A63B 71/0605; A63B 43/00; A63B 67/14; A63B 63/004; A63B 2102/24; A63B 2225/54; A63B 43/008; A63B 2225/15; A63B 2207/02

See application file for complete search history.

(56) References Cited

U.S. PATENT DOCUMENTS

| | | | | |
|---|---|---|---|---|
| 3,782,730 | A | 1/1974 | Horchler | |
| 3,872,455 | A | 3/1975 | Fuller et al. | |
| 4,375,289 | A | 3/1983 | Schmall et al. | |
| 4,968,036 | A | 11/1990 | Mark | |
| 5,564,698 | A | 10/1996 | Honey et al. | |
| 5,615,880 | A | 4/1997 | Booth et al. | |
| 5,748,073 | A | 5/1998 | Crawford | |
| 5,816,947 | A * | 10/1998 | Kavitch | A63B 24/0021 473/478 |

(Continued)

FOREIGN PATENT DOCUMENTS

| | | |
|---|---|---|
| EP | 1489572 A1 | 12/2004 |
| WO | 2007097752 | 8/2007 |

*Primary Examiner* — Jeffrey S Vanderveen

(74) *Attorney, Agent, or Firm* — Mark P. Walters; Ellen M. Bierman; Lowe Graham Jones PLLC

(57) ABSTRACT

An illuminating hockey puck and hockey goal monitoring system is provided. The hockey puck comprises a standard size hockey puck with an imbedded RF receiver, electrical circuit, and a power source therein. The receiver functions in coordination with the hockey goal monitoring system, which registers when the receiver passes over its threshold to energize a light source either in the puck or along the goal itself. The monitoring system comprises a transmitter connected to an energized wire disposed within the goal posts and over the threshold of the goal, whereby the proximity of the receiver to the wire can be measured and the system registers when the puck has entered the goal.

4 Claims, 2 Drawing Sheets

(56) References Cited

U.S. PATENT DOCUMENTS

| | | | | |
|---|---|---|---|---|
| 5,947,846 | A * | 9/1999 | Craig | A63B 24/0021 273/127 B |
| 6,126,561 | A | 10/2000 | Mark | |
| 6,972,787 | B1 | 12/2005 | Allen et al. | |
| 7,483,049 | B2 | 1/2009 | Aman et al. | |
| 7,867,113 | B2 | 1/2011 | Petersen | |
| 7,900,921 | B1 | 3/2011 | Palmer et al. | |
| 8,535,183 | B2 | 9/2013 | Eskildsen | |
| 2003/0210555 | A1 | 11/2003 | Cicero et al. | |
| 2005/0083201 | A1 | 4/2005 | Trosper | |
| 2005/0255787 | A1* | 11/2005 | Pak | A63B 19/00 446/236 |
| 2006/0267737 | A1 | 11/2006 | Colby | |
| 2007/0275801 | A1 | 11/2007 | Proulx et al. | |
| 2010/0222163 | A1* | 9/2010 | Eskildsen | A63B 63/00 473/570 |
| 2015/0011339 | A1 | 1/2015 | Kounellas | |

* cited by examiner

INFRARED HOCKEY PUCK AND GOAL DETECTION SYSTEM

CROSS REFERENCE TO RELATED APPLICATION

This application claims the benefit of U.S. Provisional Application No. 61/842,495 filed on Jul. 3, 2013 and U.S. Nonprovisional application Ser. No. 14/323,026 filed on Jul. 3, 2014. The above identified patent application is herein incorporated by reference in its entirety to provide continuity of disclosure.

BACKGROUND OF THE INVENTION

The present invention relates to sports equipment and to boundary monitoring systems therefor. More specifically, the present invention relates to a hockey system that comprises a hockey puck or ball with an imbedded RF receiver and a hockey goal with a boundary monitoring system therein that can register when the puck or ball has cross into the goal.

The sport of hockey is a fast-paced game played using hockey sticks and a single ball or puck, which is passed between players for the purpose of placing the ball or puck into a hockey goal. The speed of the players and the small size of the puck make it difficult for spectators and viewers to watch the game and recognize the location of the puck during gameplay. Visual cues from the players' movements are generally used to locate the puck, however when in proximity to the goal locating the puck becomes even more difficult. Moreover, determining when the puck has passed over the threshold of the goal can sometimes be difficult if there are several players around the goal.

When watching televised hockey games, locating the puck can be particularly difficult for viewers at home to follow the puck. Not only does this make it difficult to follow the game at times, but it can also lead to an overall decreased interest in the gameplay. Similarly, camera crews, referees, coaches, players, and goalies may also lose sight of the puck, particularly when in close proximity to the goal. This can be frustrating for all involved, and is especially problematic for referees when calling scored goals. The current methods for determining when a goal is scored involves video replay. This technique is effective, but can be hampered if the goalie or other players crowd the goal area and block the field of view of the camera within the goal. This makes determination of a scored goal impossible, particularly when many players are scrambling and the goalie is covering the puck.

To alleviate these issues, the present invention contemplates a hockey puck and an hockey goal monitoring system, wherein a specialized puck and hockey goal system are used to register when the puck has entered the goal. The hockey puck comprises a puck or ball that includes an RF receiver, while the hockey goal comprises an energized wire and transmitter, wherein the receiver in the hockey puck is registered when passing over the wire. This system is similar to an animal fence, yet tailored such that the exact position of the puck relative to the goal line can be measured to determine a scored goal. Once the puck has cross the threshold of the goal, a light source on the puck or along the goal is energized to alert fans, players, spectators, and referees of a goal.

Devices have been disclosed in the prior art that relate to hockey puck tracking systems and specialized hockey goals. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 5,564,698 to Honey, which discloses an electromagnetic transmitting hockey puck that includes a transmitter that projects electromagnetic waves outside of the visible spectrum. The waves are receives by a receiver and used to enhance the clarity of the hockey puck on a television screen without changing the outward appearance thereof for the player participants or fans. While providing a puck with a transmitter, the Honey device fails to contemplate an RF receiver used to track when the puck has cross the goal line, and further fails to contemplate an illumination source on the puck that energizes upon a given condition.

Another device is U.S. Pat. No. 5,947,846 to Craig, which discloses a score-indicating hockey goal assembly having a plurality of light sources disposed within the frame of the hockey goal. The lamps energize when a signal is received from a transmitter, which energizes the light sources to alert fans and players of a goal. Similar to the Honey device, the Craig devices fails to contemplate a system that tracks the puck location relative to the goal interior and one that can determine when the puck has entered the goal.

Overall, the present invention provides a new and improved system for tracking the location of a hockey puck in reference to a hockey goal, wherein an energized wire within the goal and an RF receiver within the hockey puck are used to determine when a goal is scored. Overall, it is submitted that the present invention is substantially divergent in design elements from the prior art, and consequently it is clear that there is a need in the art for an improvement to existing hockey goal systems. In this regard the instant invention substantially fulfills these needs.

SUMMARY OF THE INVENTION

In view of the foregoing disadvantages inherent in the known types of hockey puck and hockey goal systems now present in the prior art, the present invention provides a new hockey puck and hockey goal monitoring system that can be utilized for providing convenience for the user when determining when a hockey puck has passed over the threshold of the hockey goal.

It is therefore an object of the present invention to provide a new and improved hockey puck system that has all of the advantages of the prior art and none of the disadvantages.

It is another object of the present invention to provide a hockey puck system that illuminates when the hockey puck crosses the threshold of the hockey goal, thereby alerting players, fans, and referees of the goal.

Another object of the present invention is to provide a hockey puck system that can be used recreationally or in a competitive environment, wherein either the hockey puck itself or the goal illuminates when the hockey puck crosses the threshold of the hockey goal.

Yet another object of the present invention is to provide a hockey puck system that utilizes a wireless RF signal to register when the puck has crossed the threshold of the hockey goal.

Another object of the present invention is to provide a hockey puck system that does not alter the regulation size or weight of the hockey puck, and introduces minimal changes to the hockey goal to implement the system.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
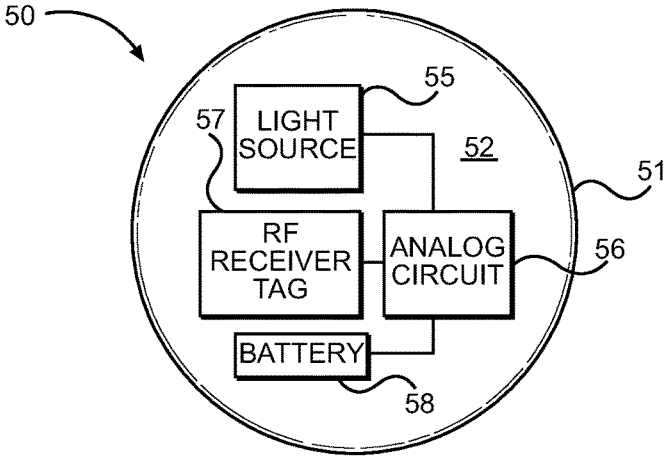
FIG. 1 shows a cross section view of an embodiment of the hockey puck of the present invention.

Reference is made herein to the attached drawings. Like reference numerals are used throughout the drawings to depict like or similar elements of the hockey puck system of the present invention. For the purposes of presenting a brief and clear description of the present invention, the preferred embodiment will be discussed as used for determining whether the hockey puck has crossed the threshold of the hockey goal and illuminating a light source when the event has occurred. The figures are intended for representative purposes only and should not be considered to be limiting in any respect.

Referring now to FIG. 1, there is shown a schematic view of the hockey puck 50 of the present invention. The hockey puck 50 is one that includes an RF receiver 57 that receives radio signals emitted from an energized wire installed along the threshold of the hockey goal. The RF receiver is a small radio receiver or an RFID tag that receives a specific radio frequency signal that the goal system emits. The threshold of the hockey goal includes an energized wire, wherein the relative location of the hockey puck can be registered by the hockey puck circuit by way of signal strength. When a given threshold is met and the calibrated signal is registered by the puck circuit 56, an illumination source 55 is energized to alert those involved of a scored goal. Generally the calibrated signal will be one in which the signal strength received by the RF receiver 57 reaches its zenith, whereby at this signal strength the puck 50 has passed completely over the goal line and into the hockey goal interior.

The RF receiver is part of an analog circuit 56 that includes a battery power source 58 and a light source 55. These elements are imbedded within the puck interior and do not change its shape or weight. The light source 55 projects through the upper and lower surfaces or the sides of the puck such that it is visible to a camera and to the naked eye when illuminated. The receiver 57 and associated circuitry 56 are adapted to receive a specific frequency signal emitted from the hockey goal system, which is emitted from a perimeter wire around the threshold of the goal. The circuit 56 registers the signal strength thereof and is calibrated to realize when the signal strength registers its peak and when this correlates to the position of the puck being over the goal line. Once the light source 55 is energized, it remains energized for a period of time, whereby a timer circuit controls its illumination. This prevents the light source from flashing for too short of a period, and allows the light source 55 to reset after a goal is scored without external controls.

Figure 2:
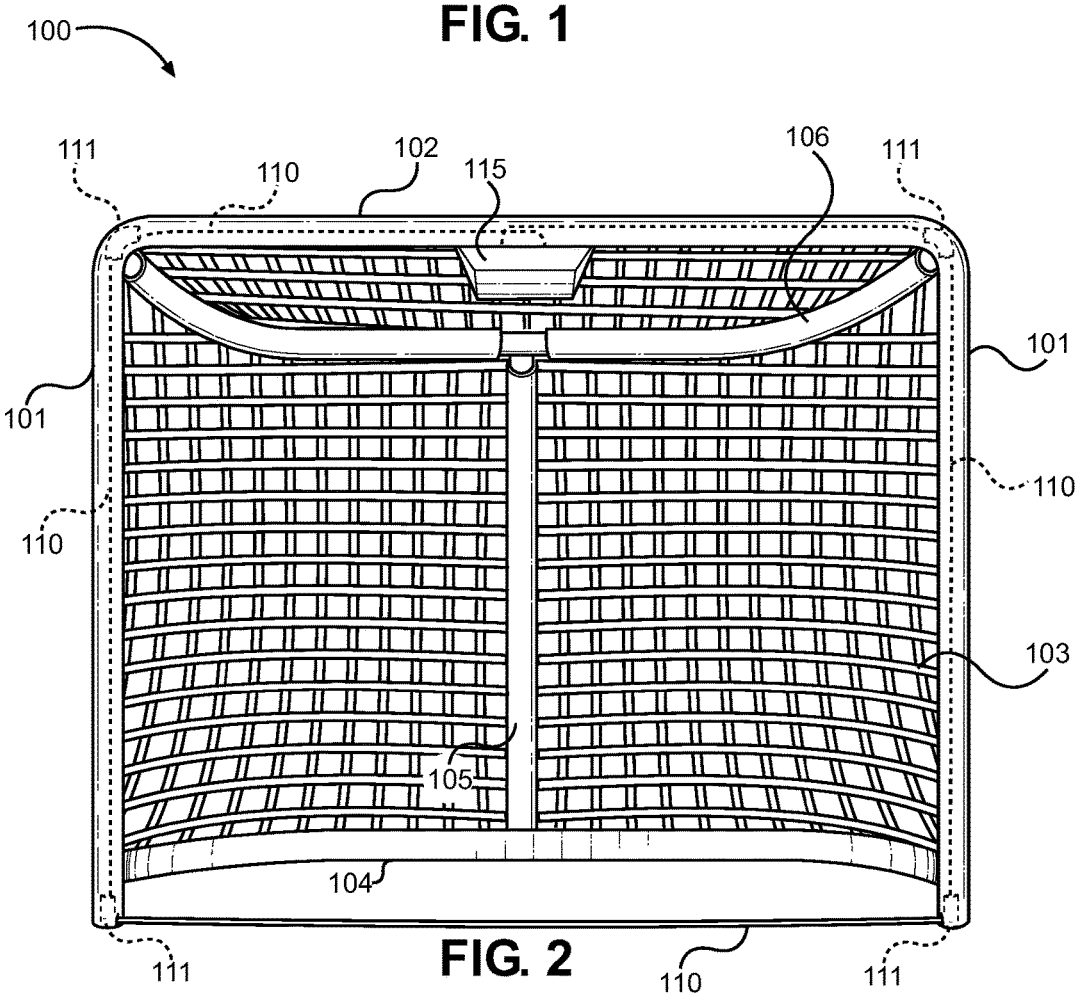
FIG. 2 shows a frontal view of the hockey goal of the present invention with the system installed.
Figure 3:
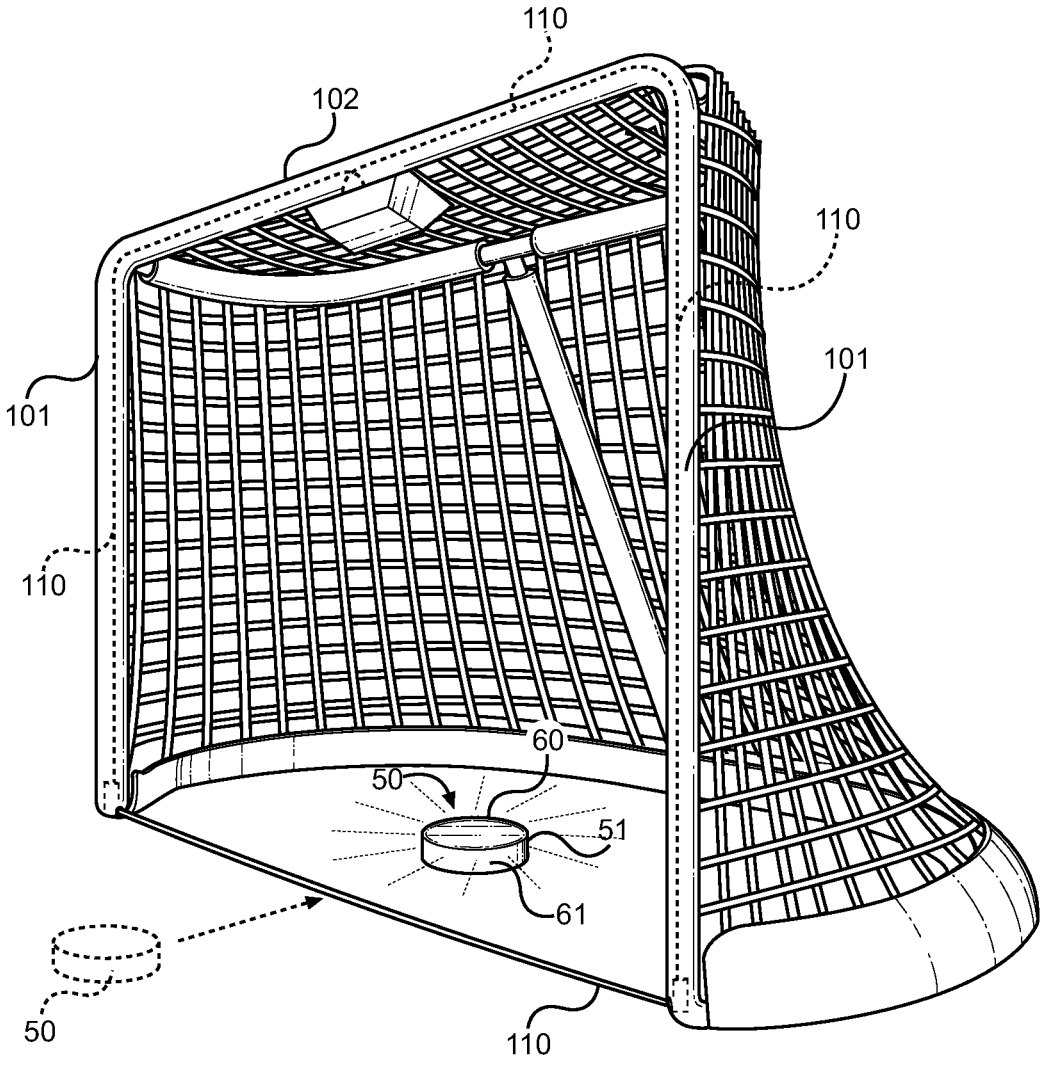
FIG. 3 shows a perspective view of the hockey goal of the present invention with the system installed.

Referring to FIGS. 2 and 3, there is shown an illustrative example of the hockey goal system of the present invention and the energized wire 110 disposed within the structure of the goal and across its threshold. Hockey goals generally include a frame comprising a pair of upright goal posts 101, a crossbar member 102, and rear frame members comprising an upper frame member 106, a lower frame member 104 and rear upright member 105. The goal posts 101 and the crossbar member 102 form the threshold of the goal, while the rear frame members support the goal netting 103 away from the threshold to provide an open goal interior. The style and sophistication of hockey goals varies with respect to the local rules and the type of environment in which the goal is used. Most hockey goals used for professional level competition also include a movable camera within the goal to visually track the puck and to view shots from a perspective within the goal interior.

The system of the present invention comprises an elongated wire 110 that is energized by a transmitter 115. The transmitter is a powered assembly that energizes the wire 110 such that the wire emits a specific frequency radio signal therefrom. The wire 110 is disposed within the interior of the goal along its threshold, whereby the wire 110 forms a closed loop around the perimeter of the goal opening. Specifically, the wire 110 is extends in a loop that starts at the transmitter 115 location and terminates at the transmitter 115 location after forming a loop about the threshold of the goal. The wire 110 is routed through the cross bar member 102, down the goal posts 101 and across the threshold of the goal along the ground surface and between the two goal posts 101. The wire then extends through the opposing goal post 101, through the cross bar member 102 and into the transmitter assembly 115once again.

The exposed wire is very thin gauged and is adapted to be positioned flushly against the ground surface or embedded therein. Its position relative to the goal line is inward within the goal with respect thereto, such that the signal strength registered by the hockey puck is created at the moment the entire puck has passed over the goal line and the hockey puck can be considered a goal. The hockey goal frame is substantially hollow, therefore the wire can be suspended therein via guides 111, which positioned the wire in a taught configuration through the interior of the goal frame and prevent grounding against any metal components therein. The guides 111 also facilitate the wire positioning centrally within the hollow interior of the frame at bends and at the exit of the wire along the goal line.

Referring specifically to FIG. 3, there is shown a perspective view of the hockey goal of the present invention and an illustrative view of the operation of the system. The hockey puck 50 comprises a standard ice hockey puck shape, or alternatively a rounded hockey ball shape, wherein the puck includes an internal RF receiver that can register the signal strength of the RF signal being emitted from the imbedded wire 110 in the hockey goal. When the signal strength reaches a predefined maximum, the puck 50 recognizes that it has passed over the threshold of the goal and the puck registers a goal. Upon registering a goal, a light source within the puck 50 illuminates, wherein the illumination is visible through the sides 51 of the puck or along the upper 60 or lower 61 surfaces thereof.

The position of the wire 110 along the threshold of the goal is important for the system to be properly functioning and such that the exposed wire does not interfere with the natural motion of the puck during gameplay. The position thereof is inward with respect to the goal line, whereby the puck registers the highest signal strength from the wire after passing over the goal line. Furthermore, the wire 110 is either flush against the ground surface or buried within the surface, whereby a slot can be created through the ice across the mouth of the goal and the wire can be burred therein and covered with ice or snow thereafter. This ensures the physical presence of the wire will not interfere with the puck if it is traveling over the goal line and along the ice surface.

The present invention describes an illuminating hockey puck. The device comprises a standard sized hockey puck without any structural changes. Internally, the puck of the present invention includes a light and a receiver. The receiver is synced with a transmitter along the goal post. The receiver activates the illumination source in the puck when the puck crosses the goal line, causing the light inside the puck to illuminate. The present invention ensures the accuracy of scored goals and eliminates the need for instant replay, and also increases overall enjoyment for hockey fans watching at the rink and at home.

In one further embodiment of the hockey puck, the puck itself is a bright neon color that is more readily visible without illuminating the light source. The flat sides of the puck may be a bright neon color, while the rounded sides are black to counterbalance the neon color for the players. Alternatively the neon color may be disposed along the rounded sides while the flat surfaces are a black rubber color.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hockey puck system, comprising:

a hockey puck having a radio frequency receiver, a light source, a power supply, and a circuit for determining signal strength;

a hockey goal comprising a goal line and a forward frame, the forward frame at least partially positioned in a plane shared with the goal line, the forward frame having a first and second upright goal post and a cross bar member, said first and second upright goal post and said cross bar member forming an inverted U-shape resting atop a first surface and each having a hollow interior;

said hockey goal further comprising a radio frequency transmitter comprising a power source, a signal generator, and an elongated wire forming a closed loop;

said elongated wire extending through said hollow interior of said first and second upright goal post, through said cross bar member, and between said first and second upright goal post to form said closed loop, wherein at least a portion of the elongated wire is either flush against said first surface or buried below said first surface; and said radio Frequency receiver being configured to register an emitted signal from said elongated wire, said emitted signal being generated from said signal generator;

wherein said at least one portion of the elongated wire is buried below said first surface inside of a slot, the slot sized to receive said at least one portion of the elongated wire and configured to be covered by ice or snow;

wherein said at least one portion of the elongated wire is inward with respect to said goal line.

2. The hockey puck system of claim 1, wherein said circuit is configured to energize said light source when said radio frequency receiver passes through said closed loop.

3. The hockey puck system of claim 1, wherein said circuit further comprises a timer circuit configured to selectively power or depower said light source being energized.

4. The hockey puck system of claim 1, wherein said radio frequency receiver registers a maximum signal strength when the puck is positioned over said goal line.

* * * * *